United States Patent [19]

Mehltretter et al.

[11] Patent Number: 4,603,814

[45] Date of Patent: Aug. 5, 1986

[54] SYSTEM FOR DISCHARGING ROTARY MILLS

[75] Inventors: James C. Mehltretter, Allendale; Winfred L. Woodard, III, Midland Park; John J. Orlando, Rivervale, all of N.J.; Charles B. Goodrich, Daytona Beach, Fla.

[73] Assignee: Inco Alloys International, Inc., Huntington, W. Va.

[21] Appl. No.: 712,704

[22] Filed: Mar. 15, 1985

[51] Int. Cl.[4] ..... B02C 17/18

[52] U.S. Cl. ..... 241/30; 241/171; 241/180; 241/DIG. 14

[58] Field of Search ..... 241/171, 172, 176, 177, 241/178, 179, 180, 181, 182, 183, DIG. 14, 31, 30

[56] References Cited

U.S. PATENT DOCUMENTS

| | | | |
|---|---|---|---|
| 10,382 | 9/1883 | Alsing | 241/180 X |
| 2,675,967 | 4/1954 | Mote | 241/171 X |
| 3,441,226 | 4/1969 | Bargero | 241/171 X |
| 4,056,230 | 11/1977 | Decobert | 241/171 X |

OTHER PUBLICATIONS

Catalog B-8 of Paul O. Abbe Inc., entitled Ball & Pebble Mills.

*Primary Examiner*—Mark Rosenbaum

*Attorney, Agent, or Firm*—Miriam W. Leff; Raymond J. Kenny

[57] ABSTRACT

A batch-type rotary grinding mill operable under seal to the atmosphere is provided with a discharge system which permits discharge of material from the mill under seal and without disturbing the seal in the mill. The discharge system comprises at least one discharge chute which is sealably secured to the shell wall, spiraling adjacent to the shell and traversing the shell wall from one end to the other. The material is discharged from the discharge chute via a hollow trunnion which, preferably, contains a conveyor to aid in passing the material out of the mill into an environmentally protected device.

26 Claims, 3 Drawing Figures

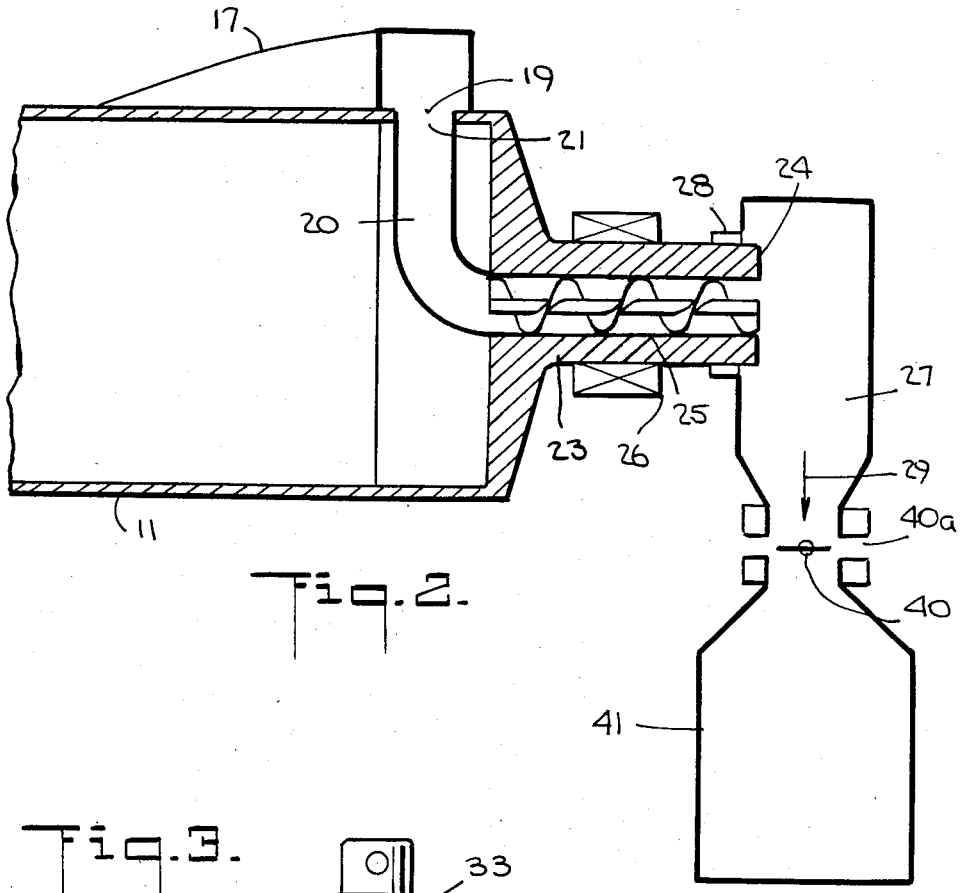
Fig. 2.
Fig. 3.
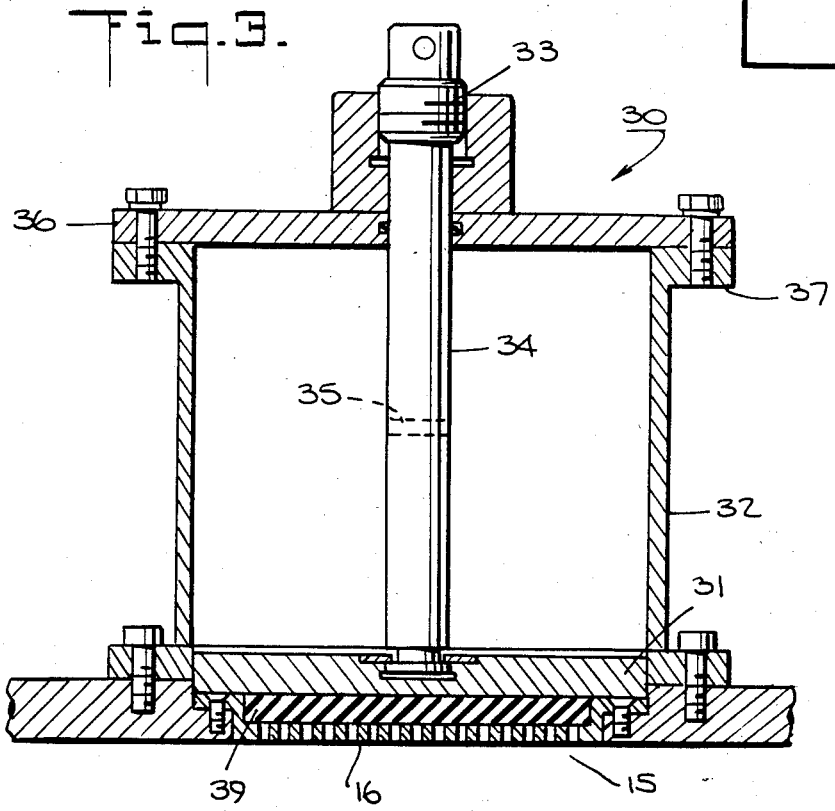

SYSTEM FOR DISCHARGING ROTARY MILLS

FIELD OF INVENTION

This invention relates to an improved system for discharging rotary grinding mills under controlled environmental conditions. More particularly it relates to a system for discharging particulate material from batch-type, rotary grinding mills under seal to the atmosphere.

BACKGROUND OF INVENTION

In milling certain types of materials it is often necessary or desirable to have a positive control of the atmosphere within the mill at all times. For example, readily oxidizable materials such as aluminum, titanium, magnesium, lithium and fine powders of many compositions are combustible or even explosive under certain conditions or they may be contaminated by the presence of air. In milling such materials the control of the atmosphere must extend to charging and discharging of the mill without opening the mill to air.

The present invention is not restricted to the processing of any particular materials. However, it is described below with reference to metal powders which are readily oxidized and are prepared as dispersion strengthened materials or alloys by powder metallurgy routes. Of necessity the milling of such materials must be carried out in a controlled atmosphere. The environment in the mill may be, for example, inert or may contain low levels of oxygen, hydrogen or hydrocarbons. To obtain such an atmosphere it is generally necessary to seal the mill to air.

The problems encountered in milling powders are particularly troublesome in the mechanical alloying of readily oxidizable metals such as aluminum, magnesium, titanium and lithium. Mechanical alloying has been described in detail in the literature and in patents. U.S. Pat. Nos. 3,740,210, 3,816,080 and 3,837,930, for example, involve the mechanical alloying of aluminum alloys and other composite materials containing aluminum. In the practice of mechanical alloying the components of the product are charged in powder form into a high energy milling device such as a ball mill where, in an environment free of or reduced in amount of free or combined oxygen, the powders are ground down to a very fine size initially, prior to particle agglomeration in the latter stages of the process. This initial grinding increases the total surface area of the metallic powders significantly. Since any freshly exposed surface of the powder is not oxidized, it is very hungry for oxygen to the extent that the powders in this condition will burn and/or might explode spontaneously if exposed to air. Thus, any port in the mill, for example, for charge or discharge of powders, is a source of potential danger from the standpoint of the quality of the product produced and the possibility of fire and/or an explosion. To avoid problems of explosion, burning and/or contamination, the mill should be emptied while maintaining positive control of the environment in the mill and throughout the entire discharging system with minimum retention of powder in the mill.

It has been known to operate a rotary ball mill with a plug in an opening in the shell, the plug being replaceable with a grate during discharge. For protection of the environment during discharge the shell is enclosed in a housing. When the milling cycle is finished the housing is opened to replace the plug with a grate, then the housing is closed for the discharge cycle. During the discharge cycle the discharge opening is rotated to the underside of the shell, thereby permitting the powder to run out into the housing. The rotation for discharge of material can be repeated. This arrangement is not satisfactory. It opens the system to the atmosphere when the plug is replaced by the grate. Powder discharged from the shell tends to accumulate in the housing, thereby requiring cleaning of the housing after each run and further opening the system to air. Opening of the housing and accumulation of powder in the housing are sources of contamination of the powder discharged from the mill and to subsequent runs in the mill. A further serious problem is that when the shell rotates inside the housing the discharging powder may be in the explosion range in terms of concentration of various portions of powder discharged in any cycle. Another proposed method for discharge is by gas sweep through the mill to pick up particles and carry them to a classification system. This involves the use of a combination of devices such as dropout chambers, cyclones, bag filters, blowers and the like. Since the powder conveyed is combustible and/or explosive, this gas sweep system poses a significant hazard. Furthermore, it is difficult to seal against infiltration of air and against leaks. It is also difficult to control the flow of powder in the discharge.

In the present system the discharge of processed material, e.g. processed to powder, is essentially gravity-dependent, the material is not aerated, it is relatively easy to keep the entire system under sealed conditions throughout the milling and discharge cycles, and the mill is discharged with minimized retention in the mill of material charged to the mill for the purpose of milling. Further advantages of the present discharge system are that the opportunity for the material being processed to degrade the system is minimized, the maintenance of the system can be achieved with minimum disturbance to the mill, and it can be done completely from the outside of the mill.

In co-pending U.S. patent application Ser. No. 712,702 filed on even date herewith a discharge system is disclosed for emptying a ball mill under sealed conditions. The disclosed discharge system can be attached to and maintained on the mill during operation of the mill, but it is designed mainly for narrow mills, i.e. up to about 2 or 3 feet in length. It could work on longer mills but would be slow and/or cumbersome. The present discharge system is an improvement over the discharge system of the aforementioned application. The present discharge system is especially useful for mills several feet long, e.g. more than about 2 or 3 feet, and it is possible to empty the mill quickly and substantially completely.

The discharge system of the present invention can be incorporated into existing batch-type rotary mills, permitting them to be discharged under protective conditions.

STATEMENT OF THE INVENTION

In accordance with the present invention a rotary, batch-type grinding mill operable under seal to the atmosphere is provided with a system for discharging material from the mill, the discharge system permitting rapid and substantially complete emptying of the mill under seal. The discharge system of the mill comprises:

(a) a rotatably mounted hollow shell having two ends and an outer side wall, means to rotate the shell, a plurality of grinding media within the shell, at least one discharge port through the outer side wall of the shell, and blocking means securable to each discharge port for preventing passage of the grinding media outwardly through the discharge port;

(b) closure means for sealing each discharge port;

(c) at least one discharge chute sealably secured to the outer side wall of the shell to receive discharge material from the shell, said chute having at least one entry port, each entry port being aligned with a discharge port and sealably covering the discharge port relative to the atmosphere, said chute spiraling adjacent to the outer wall of the shell and traversing the outer wall of the shell from one end to the other, and said chute having an unloading port;

(d) a rotatable hollow trunnion located centrally at one end of the shell, said trunnion having a receiving end and a discharge end, the receiving end being adapted to receive discharge material from the unloading port of the discharge chute;

(e) conveyor means in the hollow trunnion for advancing material to the discharge end of the trunnion;

(f) non-rotating delivery means sealably mounted to the discharge end of the rotatable trunnion, said delivery means being sealable to the atmosphere and serving as a passageway for discharge material from the trunnion out of the mill; and (g) sealable unloading means for removing discharge material from the mill under seal to the atmosphere.

In one embodiment of the invention there is one discharge chute and a plurality of discharge ports, all of the discharge ports emptying into the discharge chute, and the discharge ports leading into the discharge chute are positioned so that discharge of material can occur essentially the entire length of the mill shell. However, even if about 50% or less of the shell length is covered by discharge ports in the manner of this invention, the mill can be discharged substantially completely in an uninterrupted cycle.

To balance the mill, balancing weights may be used or more than one chute may be used, e.g. a second spiral chute can be installed opposite the first chute. This would make the mill naturally balanced, increase the discharge rate and ensure that, if desired, the entire mill length is covered by discharge means.

In a preferred embodiment of this invention the blocking means over the discharge ports are grates having openings sized to prevent the grinding media from outward discharge from the shell into the chute. The grates are sealably mounted across the discharge ports and may be located in the shell or in discharge devices, sealable in the discharge ports during the discharge mode of the mill. The grinding media may be balls, pebbles, rods or any other appropriate media.

During the grinding mode the discharge ports are sealed shut, e.g. with plates. To discharge the mill the discharge ports are unsealed, but they are blocked in respect to the grinding media, as described above. The shell is rotated during the discharge mode and as each discharge port descends to the bottom material passes into the chute. Material in the discharge chute unloads via the discharge conduit into the trunnion and then is passed out of the mill. In a preferred embodiment the trunnion is provided with a discharge screw to ensure discharge of material from the mill.

The material processed in the mill may comprise elements, compounds, mixtures, alloys, ceramics and combinations thereof. Examples of elements which may be present in major or minor amounts are nickel, copper, zinc, titanium, zirconium, niobium, molybdenum, vanadium, tin, aluminum, silicon, chromium, magnesium, lithium, iron, yttrium and rare earths; e.g. cerium and lanthanum; examples of compounds are oxides, nitrides and/or carbides of aluminum, mangesium, yttrium, cerium, silicon and lanthanum; examples of alloys are master alloys of aluminum-lithium and aluminum-magnesium. The present invention is particularly useful when the material to be processed must be charged to and/or processed in a mill under a controlled atmosphere. The present invention is particularly advantageous for processing in a ball mill metal powders which are readily oxidized and are prepared as dispersion strengthened materials or alloys by powder metallurgy routes. Of necessity the milling of such materials must carried out in a controlled atmosphere, e.g., in a hermetically sealed or a purgative atmosphere, or in an environment of controlled gas or gas flow. However, it will be understood that the present invention is, generally, especially useful for processing in a mill any materials where a controlled atmosphere is required or beneficial. For example, the present invention can be used advantageously for preparing by a powder metallurgy route dispersion strengthened alloys having, e.g., nickel, copper, iron, magnesium, titanium or aluminum as a major constituent.

BRIEF DESCRIPTION OF DRAWING

A further understanding of the invention and its advantages will become apparent from the following description taken in conjunction with the accompanying drawing in which:

FIG. 2 is a diagrammatic view in vertical section of the discharge end of a ball mill, provided with a discharge screw in the trunnion in accordance with one embodiment of the present invention.

FIG. 3 is a section of FIG. 1 showing a discharge port shown in cross section a grate to prevent the grinding media from discharging from the mill and a closure means for preventing the mill contents from discharging from the mill during processing.

DESCRIPTION OF PREFERRED EMBODIMENT

Figure 1:
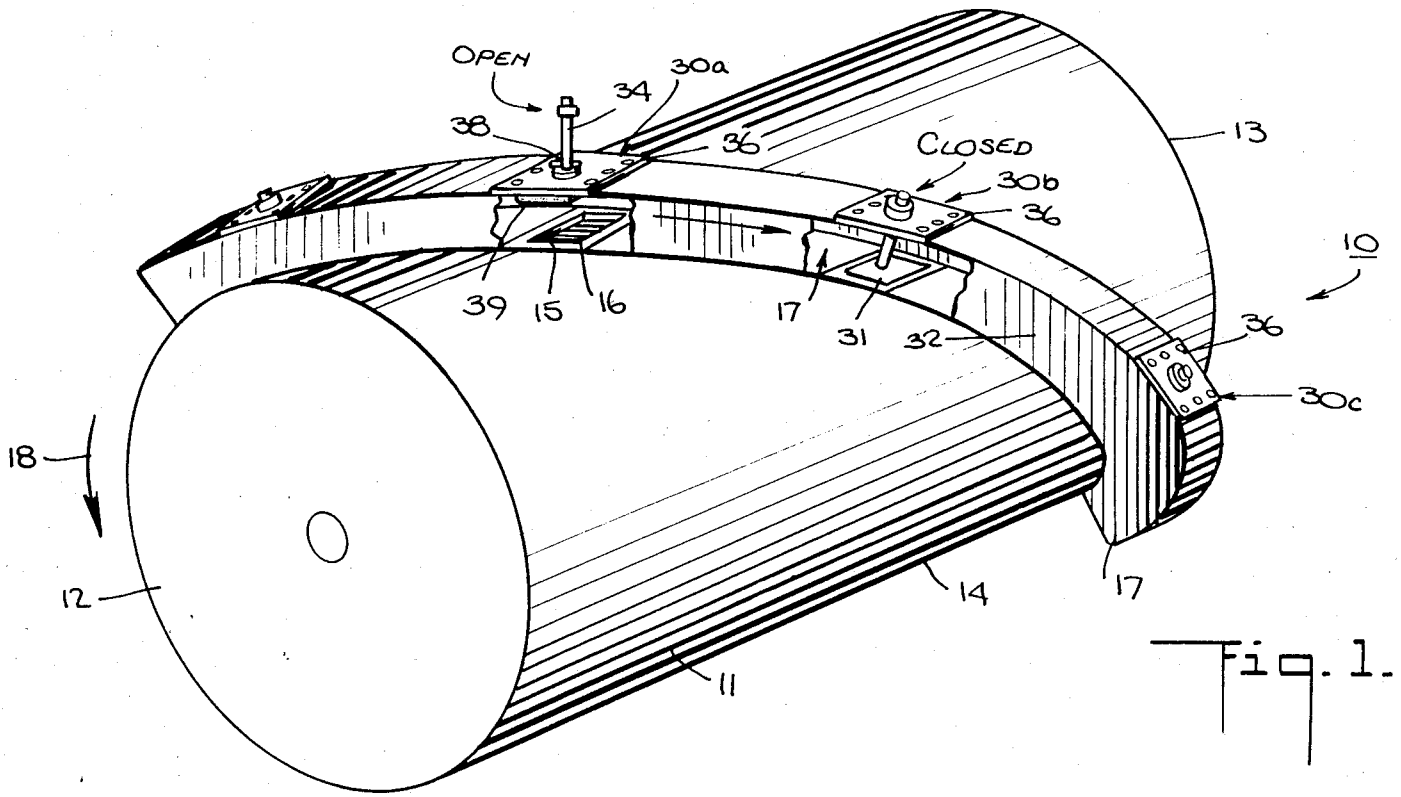
FIG. 1 is a diagrammatic partly sectioned version of a rotating shell of a ball mill with a spiral discharge chute traversing the mill shell from one end to the other in accordance with the present invention. The closure means is shown in both the open and shut positions.

Referring now to the drawing, and more particularly to FIG. 1, there is shown a portion 10 of a ball mill operable under seal to the atmosphere comprising a hollow rotatable cylindrical shell 11 having end 12 and discharge end 13 and wall 14. The shell has discharge ports 15 in the wall, each discharge port being covered, respectively, by a discharge grate 16 across the port to prevent grinding media (not shown), e.g. balls, in the shell from discharging outwardly from the shell. (Only one discharge port is visible in FIG. 1.) A hollow discharge chute 17 is sealed to the outer side of the shell and spirals around the exterior of the mill for about 180°, traversing the shell from end 12 to discharge end 13. The chute can spiral less that 180° or more, e.g. it could spiral for 360° around the shell. In respect to the distance around the shell, the important factor is that the slope of the side of the chute forms an angle with the horizontal that is greater than the angle of repose of the powder. If this is the case the powder will "fall" down this wall as the mill rotates and thus be carried from the discharge points (grates) to the end of the chute at the discharge end of the mill. The chute end blocks further flow and lifts the powder which then "falls" into the discharge conduit 20 (shown in FIG. 2). The discharge chute and discharge ports are designed so that a series of discharge ports will feed into the discharge chute along the length of the shell, and the grates across the discharge ports are flush with the interior wall (not shown) of the shell. Each discharge port is provided with a closure means 30 (*a,b* and *c*) having a retractable sealing member 31 for the port. The closure means in FIG. 1 are shown in the open position 30*a* with grate 16 exposed and in the closed position 30*b* as further described below. The direction of rotation for discharge is shown by arrow 18.

FIG. 2 shows discharge chute 17 at the discharge end 19 which is integral with and leads into discharge conduit 20, which in turn is located at the receiving end of hollow trunnion 23. Optionally a valve (not shown) may be provided at entrance port 21 to the discharge conduit 20 to provide a backup to grate seals 31, so that if there is any leakage past the grate seals it will be blocked at this point. Discharge conduit 20 is connected to hollow trunnion 23. A conveyor type spiral discharge screw 25 is affixed in hollow trunnion 23. Hollow trunnion 23, which is located centrally at one end of the cylindrical shell, rotates with the shell on bearing 26. A non-rotating discharge box 27 is sealably connected with rotating seal 28 to the hollow trunnion 23 at end 24 of the trunnion. The ball mill is rotated about its substantially horizontal axis by a motor (not shown) through a gear reduction means (not shown). An arrow 29 shows direction of powder unloading from the discharge box 27 to a container 41. Discharge box 27 is fitted with valve 40 in valve body 40*a*. Valve 40 is used to protect the atmosphere in discharge box. A discharge receptacle 41 is attached to the discharge box to receive the discharge material from the mill. Alternatively the discharge material can be passed into a conveyor device to transport the discharge material elsewhere.

A closure means 30 for the grates is shown in cross section in FIG. 3, in which an elastomer faced metal plate 31 is sealably placed over grate 16 in the discharge port 15. It will be understood that each discharge port and grate in each discharge chute will have a closure means for sealing the port to the atmosphere. The closure means of FIG. 3, is sealably mounted on discharged chute wall 32, and plate 31 having an elastomer face 39, shown in the closed position, seals the discharge port 15 having a grate 16 across it, by locking means 33, viz. a threaded section at one end of stem 34. The stem 34 is flexibly connected to plate 31. Hole 35 in stem 34 permits plate 31 to be maintained in the open position by means of locking pin 38 (shown in FIG. 1). Cover plate 36 bolted to flange 37 is removable for inspection and maintenance of the closure means.

To operate the discharge system, the grate seals (e.g. elastomeric faced plates 31) are pulled back to the inside face of cover plate 36 of the closure means 30 (as shown in the open position of FIG. 1) and secured in open position, e.g. with a locking pin or other device. The mill is then rotated, at below the critical speed for the discharge chute, and as each discharge port successively passes to the bottom of the mill the processed material, e.g. powder, falls out of the mill into the discharge chute. Because there are discharge ports all along the length of the mill, powder is removed all along the mill length. As the mill continues to rotate the powder remains on the outer periphery of the discharge chute and is transported along the mill length to the discharge end of the mill. Once the powder has reached the end of the discharge chute it is held there by the end of the discharge chute and lifted by further mill rotation. Once the angle of repose of this collected powder has been reached, it falls into the discharge conduit. The powder is thus carried to a chamber in the trunnion provided therefor and is picked up by the conveyer, e.g. a spiral discharge screw. By the rotation of the mill the spiral discharge screw transports the powder through the trunnion and discharges it into the discharge box. The powder then passes into the discharge receptacle 41.

Mill rotation is continued until all the powder has been discharged from the mill and collected. At the completion of the discharge cycle the grate seals are closed, thus isolating the discharge chute from the mill. The mill can now be recharged and another milling cycle begun.

From test run on a mill with a discharge system in accordance with this invention it is estimated that a mill with discharge ports and grates covering about 50% or even less of the mill length the mill can be emptied quickly and substantially completely in 200 revolutions. If, for example, the mill is run a 4 rpm, 200 revolutions would require only 50 minutes.

It will be understood that the drawings are relevant to the discharge system of the invention. However, a mill using the present discharge system will contain driving means for rotating the shell, grinding media means to charge the mill and other means to operate the mill and to provide a specific atmosphere in the mill are well known to those skilled in the art. A means for charging the mill under controlled conditions revealed in a co-pending patent applications Ser. Nos. 712,703 and 712,702 filed of even date herewith, can be incorporated advantageously into a mill using the discharge system of the present invention.

As described above, in some powder processing operations very fine powder is produced during the initial stages of milling. This powder is particularly hazardous. In one preferred embodiment of this invention to protect against minute leaks at the grate seal which might result in fine powder collecting in the discharge chute, a valve is placed at the entrance to the discharge conduit. This valve is kept closed during the initial rotation of the mill after the grate seals have been opened. This will blend the initial ultrafine powder with the safer processed powder and significantly reduce the hazard.

In a further preferred embodiment the discharge grate and seal assemblies are completely removable from the outside of the discharge chute, making inspection and maintenance of the system possible from outside the mill.

The entire discharge system can be filled with a gas purging means (not shown in the drawing) so that the entire discharge system can be purged with an inert or other desired gas.

The present invention can also be used to remove the grinding media (e.g. balls) from the shell under substantially sealed conditons. This can be achieved by removing one or more of the grates and rotating the mill. The grinding media could be released into a sealed receptacle such as receptacle 41 in FIG. 2.

Although the present invention has been described in conjunction with preferred embodiments, it is to be understood that modifications and variations may be resorted to without departing from the spirit and scope of the invention, as those skilled in the art will readily understand. Such modifications and variations are considered to be within the purview and scope of the invention and appended claims.

The embodiments of the invention in which an exclusive property or privilege is claimed are defined as follows:

1. A discharge system of a batch-type, rotary grinding mill, which mill is operable under seal to the atmosphere, comprising:

(a) a rotatably mounted shell having two ends and an outer side wall, means to rotate the shell, a plurality of grinding media within the shell, at least one discharge port through the outer side wall of the shell, and blocking means securable to each discharge port for preventing passage of the grinding media outwardly through said discharge port;

(b) closure means for sealing each discharge port;

(c) at least one discharge chute sealably secured to the outer side wall of the shell to receive discharge material from the shell, said chute having at least one entry port, each entry port being aligned with a discharge port and sealably covering the discharge port relative to the atmosphere, said chute spiraling adjacent to the outer wall of the shell and traversing the outer wall of the shell from one end to the other, and said chute having an unloading port;

(d) a rotatable hollow trunnion mounted axially at one end of the shell, said trunnion having a receiving and discharge end, the receiving end being adapted to receive discharge material from the unloading port of the discharge chute;

(e) conveyor means in the hollow trunnion for advancing material to the discharge end of the trunnion;

(f) non-rotating delivery means sealably mounted to the discharge end of the rotatable hollow trunnion, said delivery means being sealable to the atmosphere and serving as a passageway for discharge material from the trunnion out of the mill; and (g) sealable unloading means for removing the discharge material from the mill under seal to the atmosphere.

2. A discharge system of a mill according to claim 1, wherein the grinding media comprise balls.

3. A discharge system of a ball mill according to claim 1, wherein there are more than one discharge ports associated with each discharge chute on the mill.

4. A discharge system of a mill according to claim 1, wherein the blocking means for preventing the grinding media from outward flow through discharge ports in the shell are grates secured across said discharge ports.

5. A discharge system of a mill according to claim 1, wherein there are more than one discharge chutes attached to the outer shell of the mill.

6. A discharge system of a mill according to claim 1, wherein the discharge ports are distributed over at least about 20% of the mill length.

7. A discharge system of a mill according to claim 1, wherein the discharge ports are distributed over at least about 30% of the mill length.

8. A discharge system of a mill according to claim 1, wherein the discharge ports are distributed over at least about 50% of the mill length.

9. A discharge system of a mill according to claim 1, wherein the mill shell is at least 1 foot in length.

10. A discharge system of a mill according to claim 1, wherein the mill shell is over 2 feet in length.

11. A discharge system of a mill according to claim 1, wherein powder is discharged from the mill into the discharge chute and the discharge chute forms an angle with the horizontal that is greater than the angle of repose of powder discharged into the discharge chute.

12. A discharge system of a mill according to claim 1, wherein the discharge chute spirals around the exterior of the mill for at least about 180°.

13. A discharge system of a mill according to claim 1, wherein the conveyor means for advancing material to the discharge end of the trunnion comprises a spiral conveyor affixed in the hollow trunnion.

14. A discharge system of a ball mill according to claim 1, wherein a discharge conduit connects the unloading port of the discharge chute with the receiving end of the hollow trunnion.

15. A discharge system of a mill according to claim 14, wherein a valve means is provided to control powder flow from the discharge chute into the discharge conduit.

16. A discharge system according to claim 1, wherein said system contains only one of said discharge chutes on the shell and has more than 1 discharge ports along the length of the shell, said discharge ports being spirally located along the shell for aligned entry into the discharge chute.

17. A method of discharging powder from a batch-type grinding mill, said mill comprising a rotatably mounted shell having two ends and an outer side wall, means to rotate the shell, and a plurality of grinding media within the shell, said mill being chargeable and operable under seal to the atmosphere, comprising:

(A) providing the mill with a discharge system for powder comprising:

(1) a plurality of discharge ports through the outer wall of the shell, said ports being spaced at intervals to form a spiral pattern along the length of the mill;

(2) blocking means securable across said ports for preventing passage of grinding media outwardly through said ports;

(3) closure means for sealing the discharge ports;

(4) at least one discharge chute sealably secured to the outer side wall of the shell to receive discharge material from the shell, said chute having at least one entry port, each entry port being aligned with a discharge port and sealably covering the discharge port relative to the atmsophere, said chute spiraling adjacent to the outer wall of the shell and traversing the outer wall of the shell from one end to the other, and said chute having an unloading port;

(5) a rotatable hollow trunnion mounted axially at one end of the shell, said trunnion having a receiving end and a discharge end, the receiving end being adapted to receive discharge material from the unloading port of the discharge chute;

(6) conveyor means in the hollow trunnion for advancing material to the discharge end of the trunnion;

(7) non-rotating delivery means sealably mounted to the discharge end of the rotatable hollow trunnion, said delivery means being sealable to the atmosphere and serving as a passageway for discharge of material from the trunnion out of the mill; and (8) sealable unloading means for removing the discharge material from the mill under seal to the atmosphere (B) while the closure means for each of the discharge ports are secured across the discharge ports and the discharge delivery means is sealed to the atmosphere, charging the shell under seal with powder to be processed in the mill;

(C) processing the charge material to the extent desired;

(D) disengaging the closure means from the discharge ports; and (E) rotating the mill at a speed below the critical speed for the discharge chute, thereby discharging powder out of the mill shell across the mill length to the discharge chute, the discharge material passing from the discharge chute into the hollow trunnion, through the delivery means and into the unloading means.

18. A method according to claim 17, wherein the sealing means at the receiving end of the delivery means is sealed during the initial stages of milling, thereby ensuring against possible leaks of fine powder from the discharge chute.

19. A method according to claim 17, wherein the mill is at least 1 foot long.

20. A method according to claim 17, wherein the charge material comprises at least one of the elements selected from the group consisting of nickel, copper, zinc, titanium, zicronium, niobium, carbon, silicon, molybdenum, vanadium, tin, aluminum, chromioum, magnesium, lithium, iron, yttrium and rare earth metals.

21. A method according to claim 17, wherein the charge material comprises aluminum.

22. A method according to claim 17, wherein the charge material is processed to produce a mechanically alloyed powder.

23. A discharge system of a batch-type, rotary grinding mill, which is operable under seal to the atmosphere comprising:

(a) a rotatably mounted shell having two ends and an outer side wall, means to rotate the shell, a plurality of grinding media within the shell, more than one discharge port through the outer side wall of the shell, and blocking means securable to each discharge port for preventing passage of the grinding media outwardly through said discharge port;

(b) closure means for sealing said discharge port;

(c) at least one discharge chute sealably secured to the outer side wall of the shell to receive discharge material from the shell, said chute having more than one entry port, each entry port being aligned with a discharge port and sealably covering said discharge port relative to the atmosphere, said chute spiraling adjacent to the outer wall of the shell and traversing the outer wall of the shell from substantially one end to the other, and said chute having an unloading port;

(d) a rotatable hollow trunnion mounted axially at one end of the shell, said trunnion having a receiving and discharge end, the receiving end being adapted to receive discharge material from the unloading port of the discharge chute;

(e) means for advancing material to the discharge end of the trunnion;

(f) non-rotating delivery means sealably mounted to the discharge end of the rotatable hollow trunnion, said delivery means being sealable to the atmosphere and serving as a passageway for discharge material from the trunnion out of the mill; and (g) sealable unloading means for removing the discharge material from the mill under seal to the atmosphere.

24. A discharge system of a mill according to claim 23, wherein powder is discharged from the mill into the discharge chute and the discharge chute forms an angle with the horizontal that is greater than the angle of repose of powder discharged into the discharge chute.

25. A discharge system of a mill according to claim 23, wherein the discharge chute spirals around the exterior of the mill for at least about 180°.

26. A discharge system of a mill according to claim 23, wherein a conveyor means is located in the hollow trunnion for advancing material to the discharge end of the trunnion, said conveyor means comprising a spiral conveyor affixed in said trunnion.

* * * * *